US008042217B2

(12) United States Patent
Sorrentino

(10) Patent No.: US 8,042,217 B2
(45) Date of Patent: Oct. 25, 2011

(54) TOOTHBRUSH AND METHOD OF MAKING THE SAME

(75) Inventor: Alan Sorrentino, Cranbury, NJ (US)

(73) Assignee: Colgate-Palmolive Company, New York, NY (US)

( * ) Notice: Subject to any disclaimer, the term of this patent is extended or adjusted under 35 U.S.C. 154(b) by 659 days.

(21) Appl. No.: 10/978,477

(22) Filed: Nov. 2, 2004

(65) Prior Publication Data

US 2006/0090276 A1 May 4, 2006

(51) Int. Cl.
*A46B 9/04* (2006.01)

(52) U.S. Cl. ..... 15/167.1; 300/21

(58) Field of Classification Search ..... 15/167.1, 15/110; 300/21

See application file for complete search history.

(56) References Cited

U.S. PATENT DOCUMENTS

| | | | | |
|---|---|---|---|---|
| 585,358 | A | 6/1897 | Gould | |
| 1,251,250 | A | 12/1917 | Libby | |
| 1,327,757 | A | 1/1920 | Eggers | |
| 1,495,747 | A | 5/1924 | Izawa | |
| 1,661,713 | A | 3/1928 | Barker | |
| 1,725,852 | A | 8/1929 | Cressler | |
| 1,963,389 | A | 6/1934 | Vardeman | |
| 2,018,903 | A | 10/1935 | Stevens | |
| 2,042,239 | A | 5/1936 | Planding | |
| 2,097,987 | A * | 11/1937 | Phillips | 15/167.1 |
| D111,609 | S | 10/1938 | Lasater | |
| 2,155,473 | A | 4/1939 | Coleman | |
| 2,171,591 | A | 9/1939 | Minich | |
| 2,206,726 | A | 7/1940 | Lasater | |
| 2,219,753 | A | 10/1940 | Seguin | |
| 2,225,331 | A | 12/1940 | Campbell | |
| 2,279,355 | A | 4/1942 | Wilensky | |
| 2,548,255 | A | 4/1951 | Cressler | |
| 3,007,441 | A | 11/1961 | Eyer | |
| 3,050,072 | A | 8/1962 | Diener | |
| 3,103,027 | A | 9/1963 | Birch | |
| 3,103,935 | A | 9/1963 | Woodrow | |
| 3,125,776 | A | 3/1964 | Lilley | |
| 3,229,318 | A | 1/1966 | Clemens | |
| 3,302,230 | A | 2/1967 | Poppelman | |
| 3,359,588 | A | 12/1967 | Kobler | |
| 3,553,759 | A | 1/1971 | Kramer et al. | |

(Continued)

FOREIGN PATENT DOCUMENTS

DE 9012603 2/1992

(Continued)

OTHER PUBLICATIONS

First Office Action, State Intellectual Property Office, P.R. China, issued Feb. 20, 2009, related to corresponding Chinese Patent Application No. 200580038220.2.

(Continued)

*Primary Examiner* — Laura C Guidotti
(74) *Attorney, Agent, or Firm* — Judy W. Chung

(57) ABSTRACT

A toothbrush that provides enhanced cleaning and oral care to a user. The toothbrush has a head with cleaning elements that create a contoured cleaning profile. The cleaning elements have different depths of insertion relative to a reference plane to define a contoured cleaning profile without post-fixing trimming of the cleaning elements. Accordingly, tapered bristles can be used to define a contoured cleaning profile. Alternatively, tapered bristles of different lengths can also be used to form a contoured cleaning profile.

15 Claims, 7 Drawing Sheets

U.S. PATENT DOCUMENTS

| | | | | |
|---|---|---|---|---|
| 3,589,823 | A | | 6/1971 | Hendrickson |
| 3,618,154 | A | | 11/1971 | Muhler et al. |
| 3,691,585 | A | | 9/1972 | Flom |
| 3,879,139 | A | | 4/1975 | Dahl et al. |
| 3,917,420 | A | | 11/1975 | Watson |
| D240,677 | S | | 7/1976 | Thompson |
| 4,010,509 | A | | 3/1977 | Huish |
| 4,033,008 | A | | 7/1977 | Warren et al. |
| 4,081,877 | A | | 4/1978 | Vitale |
| 4,128,910 | A | | 12/1978 | Nakata et al. |
| 4,472,853 | A | * | 9/1984 | Rauch ..... 15/167.1 |
| 4,660,582 | A | | 4/1987 | Taylor |
| 4,691,405 | A | | 9/1987 | Reed |
| 4,706,322 | A | * | 11/1987 | Nicolas ..... 15/106 |
| 4,738,001 | A | | 4/1988 | Shipp |
| 4,802,255 | A | | 2/1989 | Breuer et al. |
| 4,852,202 | A | | 8/1989 | Ledwitz |
| 5,040,260 | A | | 8/1991 | Michaels |
| 5,044,041 | A | | 9/1991 | Ljungberg |
| D322,893 | S | | 1/1992 | Kihara |
| D324,456 | S | | 3/1992 | Rolleri |
| 5,137,039 | A | | 8/1992 | Klinkhammer |
| 5,171,066 | A | | 12/1992 | Klinkhammer |
| 5,184,368 | A | | 2/1993 | Holland |
| D334,473 | S | | 4/1993 | Volpenhein et al. |
| 5,224,764 | A | | 7/1993 | Klinkhammer |
| 5,228,466 | A | | 7/1993 | Klinkhammer |
| 5,268,005 | A | | 12/1993 | Suhonen |
| 5,284,168 | A | | 2/1994 | Klinkhammer |
| 5,305,489 | A | * | 4/1994 | Lage ..... 15/167.1 |
| 5,305,492 | A | | 4/1994 | Giuliani et al. |
| 5,315,731 | A | | 5/1994 | Millar et al. |
| 5,316,027 | A | | 5/1994 | Klinkhammer |
| 5,325,560 | A | | 7/1994 | Pavone et al. |
| 5,340,581 | A | | 8/1994 | Tseng et al. |
| 5,345,645 | A | | 9/1994 | Page |
| 5,345,646 | A | | 9/1994 | Rothweiler |
| 5,360,026 | A | | 11/1994 | Klinkhammer |
| 5,392,483 | A | | 2/1995 | Heinzelman et al. |
| 5,398,367 | A | | 3/1995 | Lu |
| 5,474,366 | A | | 12/1995 | Strutt et al. |
| 5,491,865 | A | | 2/1996 | Gueret |
| 5,497,526 | A | | 3/1996 | Klinkhammer |
| 5,500,975 | A | * | 3/1996 | Sano ..... 15/167.1 |
| 5,511,275 | A | | 4/1996 | Volpenhein et al. |
| 5,531,582 | A | | 7/1996 | Klinkhammer |
| 5,533,227 | A | | 7/1996 | Ito et al. |
| 5,533,791 | A | | 7/1996 | Boucherie |
| D378,711 | S | | 4/1997 | Occhetti |
| 5,636,405 | A | | 6/1997 | Stone et al. |
| D380,302 | S | | 7/1997 | Volpenhein |
| 5,655,249 | A | | 8/1997 | Li |
| 5,664,278 | A | | 9/1997 | Reisman |
| 5,669,097 | A | | 9/1997 | Klinkhammer |
| 5,723,132 | A | | 3/1998 | Tseng et al. |
| 5,728,408 | A | | 3/1998 | Boucherie |
| 5,765,252 | A | | 6/1998 | Carr |
| D397,251 | S | | 8/1998 | Eguchi et al. |
| 5,806,127 | A | | 9/1998 | Samoil et al. |
| 5,823,633 | A | | 10/1998 | Weihrauch |
| D400,713 | S | | 11/1998 | Solanki |
| 5,836,769 | A | | 11/1998 | Spencer |
| 5,851,551 | A | | 12/1998 | Tseng et al. |
| 5,860,183 | A | | 1/1999 | Kam |
| D405,612 | S | | 2/1999 | Swanson |
| 5,906,834 | A | | 5/1999 | Tseng |
| 5,926,897 | A | | 7/1999 | Volpenhein |
| 5,926,900 | A | | 7/1999 | Bennett |
| 5,930,860 | A | | 8/1999 | Shipp |
| 5,974,619 | A | * | 11/1999 | Weihrauch ..... 15/186 |
| 5,991,957 | A | | 11/1999 | Watanabe |
| 5,998,431 | A | | 12/1999 | Tseng et al. |
| 6,018,840 | A | | 2/2000 | Guay et al. |
| 6,021,541 | A | | 2/2000 | Mori et al. |
| 6,033,733 | A | | 3/2000 | Samoil et al. |
| 6,035,476 | A | | 3/2000 | Underwood et al. |
| 6,041,467 | A | | 3/2000 | Roberts et al. |
| 6,044,514 | A | | 4/2000 | Kaneda et al. |
| 6,058,541 | A | | 5/2000 | Masterman et al. |
| 6,088,869 | A | | 7/2000 | Kaneda et al. |
| 6,088,870 | A | * | 7/2000 | Hohlbein ..... 15/167.1 |
| 6,090,488 | A | | 7/2000 | Kweon |
| 6,108,849 | A | | 8/2000 | Weihrauch |
| D436,733 | S | | 1/2001 | Klein |
| 6,168,241 | B1 | | 1/2001 | Zapanta |
| 6,178,583 | B1 | | 1/2001 | Volpenhein |
| 6,202,241 | B1 | | 3/2001 | Hassell et al. |
| 6,237,183 | B1 | | 5/2001 | Fischer |
| 6,260,227 | B1 | | 7/2001 | Fulop et al. |
| 6,290,302 | B1 | | 9/2001 | Boucherie |
| 6,308,367 | B1 | * | 10/2001 | Beals et al. ..... 15/167.1 |
| 6,311,358 | B1 | * | 11/2001 | Soetewey et al. ..... 15/110 |
| 6,314,605 | B1 | | 11/2001 | Solanki et al. |
| 6,321,407 | B1 | | 11/2001 | Weihrauch |
| D453,998 | S | | 3/2002 | Ping |
| 6,357,074 | B1 | | 3/2002 | Weihrauch |
| 6,370,724 | B1 | | 4/2002 | Holmes et al. |
| 6,406,099 | B2 | | 6/2002 | Boucherie |
| 6,412,139 | B1 | | 7/2002 | Weihrauch |
| 6,438,786 | B2 | | 8/2002 | Harada |
| 6,523,907 | B1 | | 2/2003 | Buckner et al. |
| 6,546,586 | B2 | | 4/2003 | Cho |
| 6,554,614 | B1 | | 4/2003 | Dubbe et al. |
| D474,028 | S | | 5/2003 | Ping |
| 6,582,028 | B2 | | 6/2003 | Buchholz |
| 6,597,468 | B1 | | 7/2003 | Inuiya |
| 6,597,469 | B1 | | 7/2003 | Kuroyanagi |
| D480,876 | S | | 10/2003 | Harada |
| D484,311 | S | | 12/2003 | Cacka et al. |
| D487,351 | S | | 3/2004 | Frazell |
| 6,732,398 | B2 | | 5/2004 | McConnell |
| 6,735,804 | B2 | | 5/2004 | Carlucci et al. |
| 6,764,142 | B2 | | 7/2004 | Kwon |
| 6,766,549 | B2 | | 7/2004 | Klupt |
| 6,772,467 | B1 | | 8/2004 | Weihrauch |
| 6,792,642 | B2 | | 9/2004 | Wagstaff |
| 6,810,551 | B1 | | 11/2004 | Weihrauch |
| 6,832,819 | B1 | | 12/2004 | Weihrauch |
| 6,851,153 | B2 | * | 2/2005 | Lehman ..... 15/167.1 |
| 6,859,969 | B2 | | 3/2005 | Gavney, Jr. et al. |
| 6,871,373 | B2 | | 3/2005 | Driesen et al. |
| 6,957,468 | B2 | | 10/2005 | Driesen et al. |
| 6,957,469 | B2 | | 10/2005 | Davies |
| 6,962,160 | B2 | | 11/2005 | Dumler |
| D514,815 | S | | 2/2006 | Moskovich et al. |
| 6,996,870 | B2 | | 2/2006 | Hohlbein |
| 7,047,589 | B2 | | 5/2006 | Gavney, Jr. |
| 7,051,394 | B2 | | 5/2006 | Gavney, Jr. |
| 7,089,621 | B2 | | 8/2006 | Hohlbein |
| 7,134,162 | B2 | | 11/2006 | Kweon et al. |
| 2001/0003600 | A1 | | 6/2001 | Guay |
| 2001/0038914 | A1 | | 11/2001 | Guay et al. |
| 2002/0081556 | A1 | | 6/2002 | Tseng et al. |
| 2002/0116778 | A1 | | 8/2002 | Kwon |
| 2002/0152565 | A1 | | 10/2002 | Klupt |
| 2002/0162183 | A1 | | 11/2002 | Cho |
| 2003/0049209 | A1 | | 3/2003 | Tseng et al. |
| 2003/0115701 | A1 | | 6/2003 | Edwards |
| 2003/0115703 | A1 | | 6/2003 | Edwards |
| 2003/0163884 | A1 | | 9/2003 | Weihrauch |
| 2003/0221272 | A1 | | 12/2003 | Lehman |
| 2003/0229959 | A1 | | 12/2003 | Gavney, Jr. et al. |
| 2004/0083569 | A1 | | 5/2004 | Kweon et al. |
| 2004/0103492 | A1 | | 6/2004 | Kwon et al. |
| 2004/0128784 | A1 | | 7/2004 | Ben-Ari |
| 2004/0134010 | A1 | | 7/2004 | Tseng et al. |
| 2004/0154112 | A1 | | 8/2004 | Braun et al. |
| 2004/0237226 | A1 | | 12/2004 | Hohlbein et al. |
| 2005/0000048 | A1 | | 1/2005 | Hohlbein |
| 2005/0091769 | A1 | | 5/2005 | Jimenez et al. |
| 2005/0091773 | A1 | | 5/2005 | Gavney, Jr. et al. |
| 2005/0138744 | A1 | | 6/2005 | Hohlbein |
| 2005/0235439 | A1 | | 10/2005 | Braun et al. |
| 2005/0278874 | A1 | | 12/2005 | Blaustein et al. |
| 2006/0026784 | A1 | | 2/2006 | Moskovich et al. |
| 2006/0057087 | A1 | | 3/2006 | Moskovich et al. |
| 2006/0064827 | A1 | | 3/2006 | Chan |

| | | | |
|---|---|---|---|
| 2006/0117506 | A1 | 6/2006 | Gavney, Jr. et al. |
| 2006/0236478 | A1 | 10/2006 | Hohlbein et al. |
| 2006/0277701 | A1 | 12/2006 | Eliav |
| 2007/0033757 | A1 | 2/2007 | Storkel et al. |
| 2007/0130705 | A1 | 6/2007 | Chan et al. |
| 2007/0174978 | A1 | 8/2007 | Eliav et al. |
| 2007/0204417 | A1 | 9/2007 | Russell et al. |

FOREIGN PATENT DOCUMENTS

| | | | |
|---|---|---|---|
| DE | 42 24 903 | A1 | 2/1994 |
| DE | 44 18 854 | A1 | 12/1995 |
| DE | 102 21 786 | A1 | 11/2003 |
| DE | 10221786 | | 11/2003 |
| EP | 0148726 | | 11/1984 |
| EP | 596633 | | 10/1993 |
| EP | 1199957 | | 5/2002 |
| EP | 1234525 | A2 | 8/2002 |
| EP | 1 350 442 | A | 10/2003 |
| EP | 1415572 | A1 | 5/2004 |
| EP | 1425989 | A1 | 6/2004 |
| GB | 501 124 | A | 2/1939 |
| GB | 2214420 | | 1/1988 |
| JP | 07213346 | | 8/1995 |
| JP | 7284412 | | 10/1995 |
| JP | 08182694 | | 7/1996 |
| JP | 9299147 | | 11/1997 |
| JP | 9299148 | | 11/1997 |
| JP | 10057149 | | 3/1998 |
| JP | 10225324 | | 8/1998 |
| JP | 1156478 | | 3/1999 |
| JP | 11075939 | | 3/1999 |
| JP | 11169232 | | 6/1999 |
| JP | 2000033010 | | 2/2000 |
| JP | 2000189252 | | 7/2000 |
| JP | 2000270928 | | 10/2000 |
| JP | 2000279230 | | 10/2000 |
| JP | 2000296024 | | 10/2000 |
| JP | 2000354520 | | 12/2000 |
| JP | 2001178543 | | 7/2001 |
| JP | 2001218623 | | 8/2001 |
| JP | 2001299452 | | 10/2001 |
| JP | 2001346631 | | 12/2001 |
| JP | 2001346632 | | 12/2001 |
| JP | 2001353026 | | 12/2001 |
| JP | 2002065360 | | 3/2002 |
| JP | 2002159345 | | 6/2002 |
| JP | 2002172023 | | 6/2002 |
| JP | 2002186521 | | 7/2002 |
| JP | 2002223855 | | 8/2002 |
| JP | 2002223856 | | 8/2002 |
| JP | 2002360344 | | 12/2002 |
| JP | 2003144230 | | 5/2003 |
| JP | 2003169718 | | 6/2003 |
| JP | 2003199626 | | 7/2003 |
| JP | 2003245134 | | 9/2003 |
| JP | 2003319833 | | 11/2003 |
| JP | 2003339445 | | 12/2003 |
| JP | 2004148095 | | 5/2004 |
| JP | 2004202065 | | 7/2004 |
| JP | 2004208816 | | 7/2004 |
| SU | 1546067 | | 2/1990 |
| WO | WO 98/03097 | | 1/1998 |
| WO | WO 98/18364 | | 5/1998 |
| WO | WO 98/38889 | A | 9/1998 |
| WO | WO 01/10267 | A1 * | 2/2001 |
| WO | WO 01/82741 | A | 11/2001 |
| WO | WO 03/032772 | A1 | 4/2003 |
| WO | 2004049860 | A1 | 6/2004 |
| WO | 2004080237 | A1 | 9/2004 |
| WO | 2004113047 | A1 | 12/2004 |
| WO | 2005087045 | A1 | 9/2005 |
| WO | 2005087046 | A1 | 9/2005 |
| WO | WO 2006/062265 | | 6/2006 |
| WO | 2006095937 | A1 | 9/2006 |
| WO | 2006101286 | A1 | 9/2006 |
| WO | 2006107123 | A1 | 10/2006 |
| WO | 2006129895 | A1 | 12/2006 |
| WO | 2007043848 | A1 | 4/2007 |
| WO | 2007073045 | A1 | 6/2007 |

OTHER PUBLICATIONS

Official Action, Patent Office of the Russian Federation, issued May 29, 2009, related to corresponding Russian Patent Application No. 2007120527.

* cited by examiner

TOOTHBRUSH AND METHOD OF MAKING THE SAME

FIELD OF THE INVENTION

The present invention relates to a toothbrush having a unique mounting of the cleaning elements, which is particularly beneficial in forming a contoured cleaning profile, and especially a contoured profile formed of tapered bristles. The present invention also pertains to a novel process for making such a toothbrush.

BACKGROUND OF THE INVENTION

A toothbrush is used to clean teeth by removing plaque and debris from tooth surfaces, the gums, the interproximal areas between adjoining teeth, and the marginal areas between the teeth and gums. Toothbrushes have been provided with a myriad of cleaning elements and profiles in an effort to provide comfort and enhanced cleaning. For example, toothbrushes with bristle tufts presenting a contoured profile have long been provided for more effective cleaning of the teeth and gums. Additionally, tapered bristles have been used for increased comfort and better cleaning of the interproximal areas.

However, the combined beneficial effect of tapered bristles and a contoured profile has not been realized. Typically, bristles are fixed into the head of a toothbrush and then trimmed to obtain the desired profile. This conventional process of trimming the bristles has hindered the adoption of tapered bristles into toothbrushes; i.e., tapered bristles have heretofore been limited to flat profiles to avoid trimming off of the tapered ends.

Further, the conventional manufacturing process for toothbrushes requires multiple steps to obtain a contoured profile, including the fixing of bristles into the head and one or more steps of trimming and endrounding of the fixed bristles.

BRIEF SUMMARY OF THE INVENTION

The present invention pertains to a toothbrush with a unique mounting construction for the cleaning elements. This construction is especially effective in forming contoured cleaning profiles with tapered bristles.

In one aspect of the invention, cleaning elements are secured within the head at varying depths to enable greater versatility in cleaning arrangements and an improved manufacturing process In another aspect of the present invention, tapered cleaning elements extend from a head of a toothbrush so as to form a contoured cleaning profile for more effective cleaning.

In another aspect of the invention, tapered bristles are uniquely mounted within the head of a toothbrush to define a contoured cleaning profile. In one construction, tapered bristles formed of different lengths are secured to the head in an arrangement to form the desired profile. In another construction, tapered bristles are secured at varying depths of insertion into the head to define the desired contoured cleaning profile.

In another aspect of the invention, a toothbrush is formed by fixing cleaning elements into the head of the toothbrush at varying depths. Alternatively, tapered bristles having alternative lengths can be fixed into the head. With either of these processes, a contoured cleaning profile can be formed without trimming and endrounding of the cleaning elements. The elimination of such conventional post-fixing step(s) can enhance the manufacture of such brushes. Moreover, with this process, tapered cleaning elements can be effectively used in a toothbrush having a contoured profile.

DETAILED DESCRIPTION OF THE INVENTION

Figure 1:
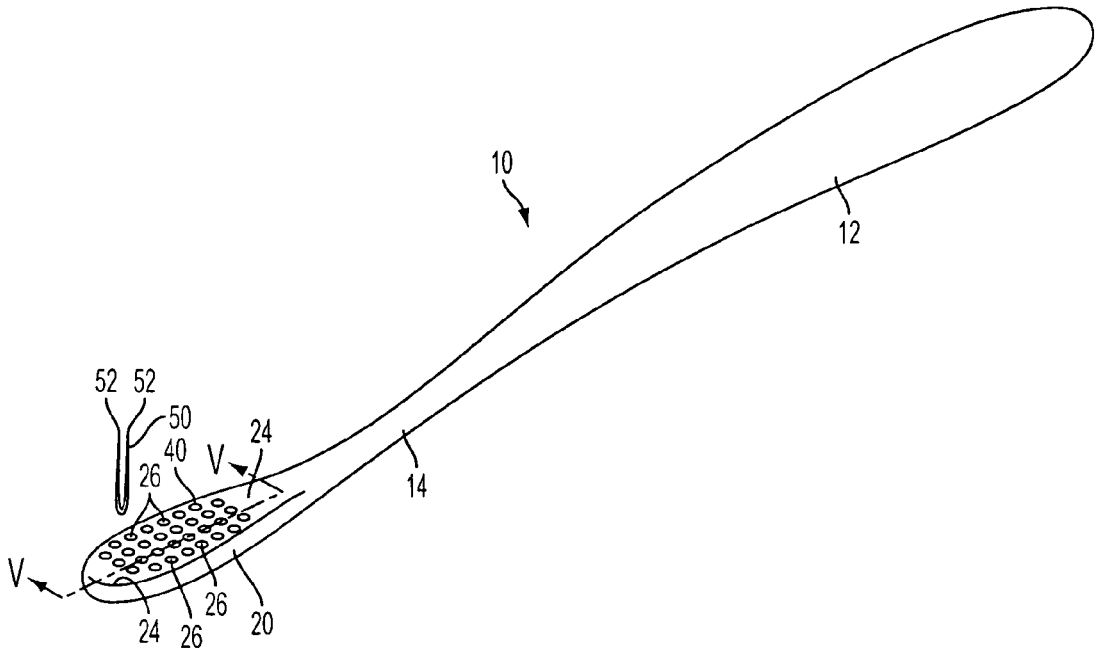
FIG. 1 is an exploded perspective view of a toothbrush in accordance with the present invention showing only a single cleaning element.
Figure 2:
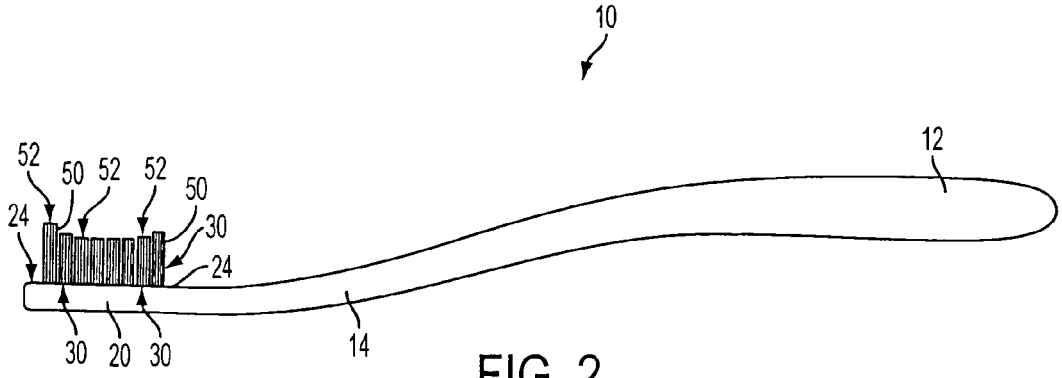
FIG. 2 is a side view of the toothbrush of FIG. 1.
Figure 4:
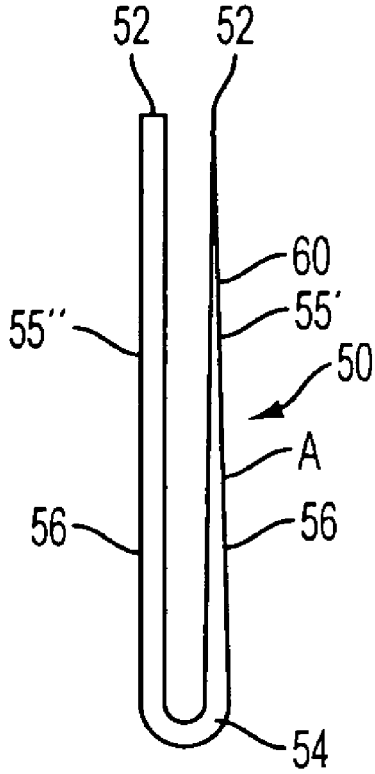
FIG. 4 is a side view of an alternative sample cleaning element usable in a toothbrush of FIG. 1.
Figure 5:
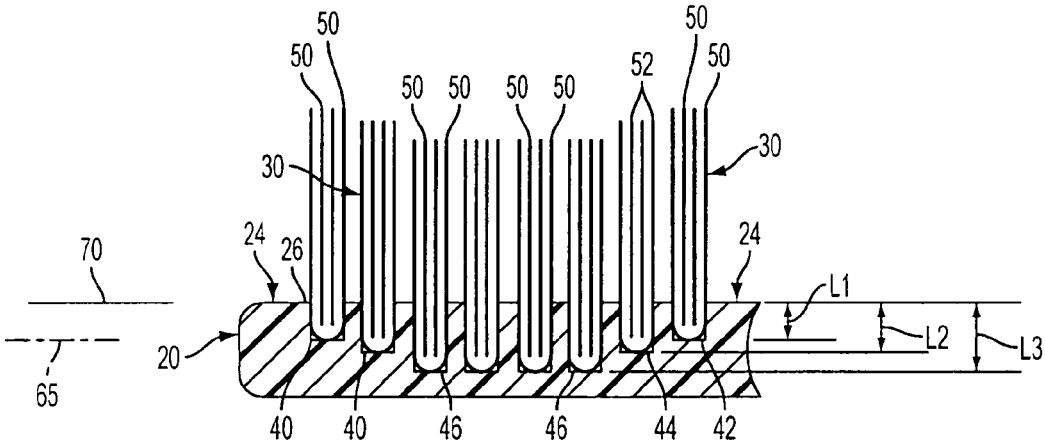
FIG. 5 is a cross sectional view of the toothbrush taken along line V-V in FIG. 1.

FIGS. 1 and 2 illustrate a toothbrush 10 according to the present invention. The toothbrush 10 includes a handle 12, a neck 14 and a head 20. Cleaning elements 50 usually in the form of tufts 30 are fixed to head 20 for cleaning the teeth and gums of a user. The cleaning elements are preferably tapered bristles (see, e.g., FIGS. 3 and 4), although they could be formed of non-tapered bristles or various forms of elastomeric or other cleaning members including tapered and/or non-tapered elements. As illustrated in FIGS. 2 and 5, the tufts 30 and their associated cleaning elements 50 preferably form a contoured cleaning profile (i.e., the collective profile of the remote ends of the cleaning elements adapted to engage the teeth) on head 20 for enhanced cleaning. While a simple bowed profile of the cleaning elements is illustrated in the figures, virtually any contoured profile could be used.

In one construction, head 20 includes a mounting surface 24 having a plurality of spaced holes 40 each receiving a tuft 30 of tapered bristles or other cleaning element(s) 50. The holes 40 can be formed to each receive the same number and type of cleaning elements or a different number or type of cleaning elements. For example, a plurality of the holes 40 can receive single tooth care elements 50, such as massaging elements, while the remaining holes 40 receive tufts 30 of tooth care elements 50, such as bristles.

Figure 3:
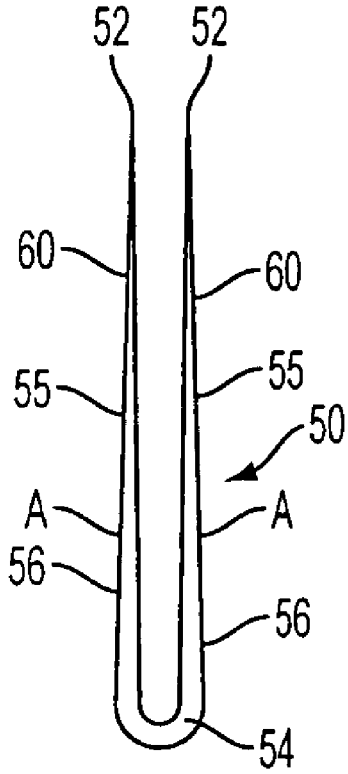
FIG. 3 is a side view of a sample cleaning element usable in the toothbrush of FIG. 1.

In one embodiment, each bristle 50 has an anchoring portion 54 and a pair of strands 55 which extend to terminal ends 52 (FIG. 3). Anchoring portion 54 is adapted to be secured within a hole 40, typically with a plurality of other bristles to form a tuft 30. Strands 55 extend outward from head 20 to engage and clean the user's teeth and gums. Each of strands 55 may be tapered as shown in FIG. 3. Alternatively, one strand may be tapered 55' while the other strand 55" is not (FIG. 4). The untapered strand 55" may not be as tall as the tapered strand 55' so as to not interfere with the brushing action of the tapered strand 55". The tapered working ends 52 are better able to enter the areas between the teeth and between the teeth and gums, and go deeper between them for effective cleaning. In either case, such bristles are referred to herein as tapered bristles 50. Further, such bristles may be formed of fibers, elastomeric material, etc., and have strands of equal or unequal lengths, virtually any cross-sectional shape, and uniform or varying cross-sectional shapes.

As shown in FIG. 3, tapered bristles typically include strands with a non-tapering base portion 56 proximate the mounting surface 24 and a tapering working portion 60 to engage the teeth and gums of the user. Tapered portion 60 of each cleaning element 50 extends between a point A and the working end 52. In the illustrated embodiment, cleaning elements 50 are each free of a taper between their anchoring portion 54 and point A. As examples only, point A can be between about 6.5 mm and 12 mm from the corresponding end 52. In one preferred embodiment, Point A is located about 10.5 mm from the terminal end 52. Nevertheless, point A could vary toward or away from anchoring portion 54 or the strands could be tapered along their entire lengths. Moreover, the bristles could have only one strand or be split into more than two strands. Also, the same features can be included in cleaning elements that are not bristles.

In the embodiment illustrated in FIG. 5, the bristles or other cleaning elements 50 each preferably have the same length (although this is not essential). The holes 40 that receive these cleaning elements 50 have varied depths of insertion relative to a reference plane 70 to create the desired contoured cleaning profile. Reference plane 70 is generally parallel to a plane of engagement with the user's teeth (i.e., an imaginary plane that generally extends along the outer surfaces of two adjacent teeth) and coextensive with the outer-most portion of the mounting surface. In this embodiment, the reference plane is coextensive with mounting surface 24. In one construction, tufts 30 are fixed in holes 40 such that the strands 55 extend out from mounting surface 24 and away from head 20. The depth of the holes 40 determines the extension of the cleaning elements from the mounting surface 24 so as to create the contoured cleaning profile. As can be appreciated, adjacent holes 40 can extend the same distance or different distances into the head 20 from the mounting surface 24.

In one example, a first hole 42 extends a first distance L1 into head 20 from mounting surface 24 (FIG. 5). A second hole 44 extends a second distance L2 into head 20 from mounting surface 24. The second distance L2 is, in this example, larger than the first distance. However, the second distance could be less than the first distance (or the same) depending on the desired contour of the cleaning profile. Likewise, head 20 can include a third hole 46 that extends a third distance L3 into the head 20. This third distance can be greater or less than either or both of the first and second distances. As can be appreciated, any number of holes provided at different depths could be used. In the example of FIG. 5, head 20 includes multiple holes 42 that extend at the first depth, multiple tuft holes 44 that extend at the second depth, and multiple tuft holes 46 that extend at the third depth.

Holes 40 are generally circular in cross section, although they can have any shaped cross section including square, rectangular, diamond, crisscross-shaped, etc. In one example, holes 40 have a diameter of between about 1.2 and 2.0 mm and depths generally extending about 2-5 mm. Nevertheless other diameters and depths could be used as desired.

Figure 5A:
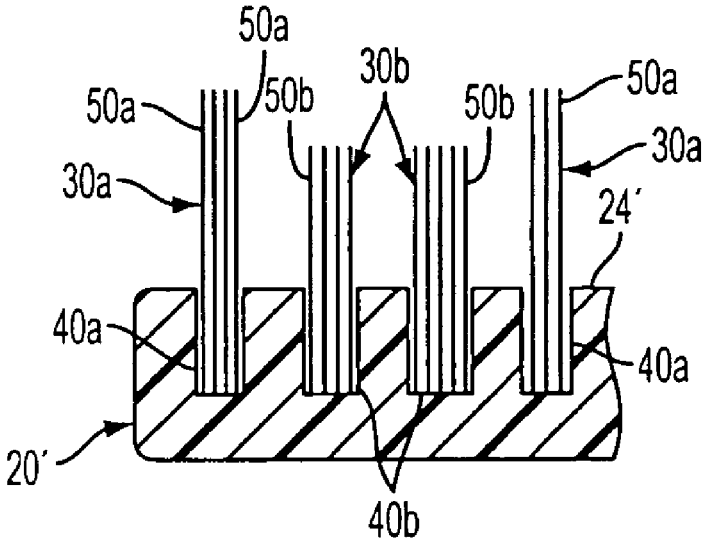
FIG. 5A is a partial longitudinal cross-sectional view of the head of an alternative embodiment.

Tapered bristles are generally manufactured at set lengths for use in toothbrushes. As discussed above, bristles having the same lengths can be used to form contoured cleaning profiles without trimming and endrounding of the terminal ends. Further, the use of bristles manufactured at different lengths can also be used to define a contoured cleaning profile with or without varying the hole lengths or the depths of insertion of the bristles into the head. As seen in FIG. 5A, a first set of tapered bristles 50*a* of a first length are secured within holes 40*a*. Similarly, a second set of tapered bristles 50*b* of a second length, shorter than the first length, are secured within holes 40*b*. In this construction, holes 40*a* and 40*b* all have the same depth from mounting surface 24'. Nevertheless, as can be appreciated, the securing of differently sized tapered bristles in the head can be used define various cleaning profiles. As an example only, the tapered bristles may be formed to have total lengths of 30 mm and 26 mm respectively. Due to the folded nature of the bristles in use, this will create a difference of about 2 mm in the projecting lengths of the tufts 30*a*, 30*b* extending from head 20'. Other lengths and additional numbers of different lengths can be used to define the desired contoured cleaning profiles. The bristles may also, of course, be fixed within the head by means other than anchoring within a pre-formed hole. Finally, a combination of varying holes and varying bristle lengths can be used to cooperatively form virtually any contoured profile with tapered bristles.

Figure 6:
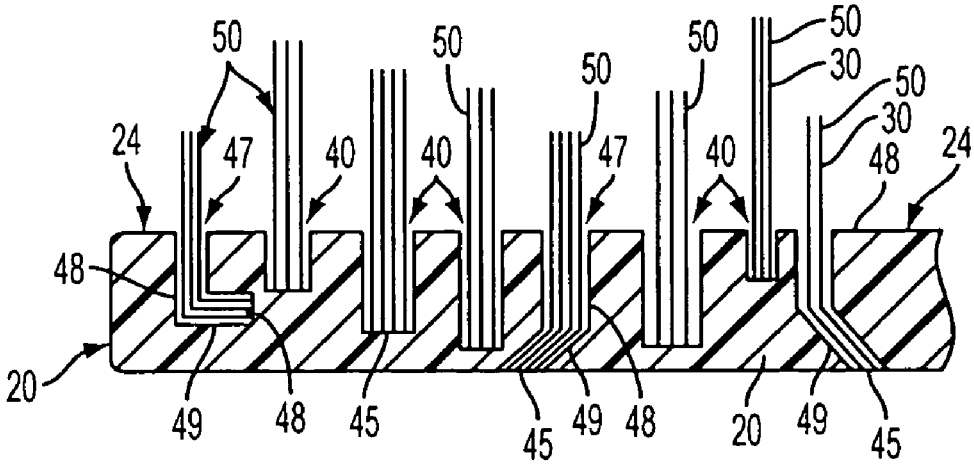
FIG. 6 is a longitudinal cross sectional view of the head of an alternative embodiment of the toothbrush.
Figure 7:
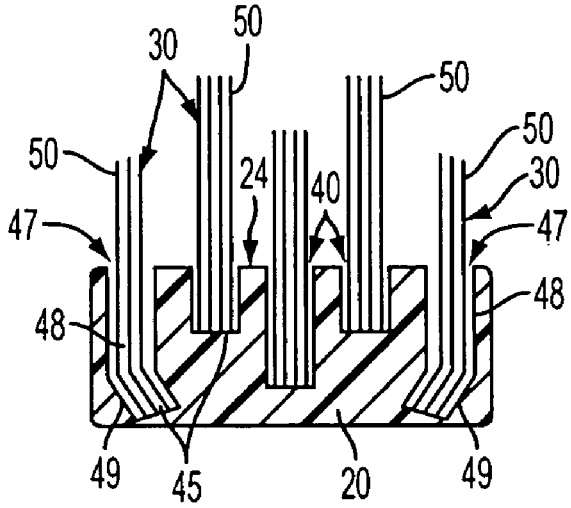
FIG. 7 is a lateral cross sectional view of the head of an alternative embodiment of the toothbrush.

While FIG. 5 illustrates holes having uniform shapes and orientations, the depths of insertion could be varied in other alternative ways. For example, holes 47 could be formed with angled or curved sections 48, 49 that are bent relative to each other (FIGS. 6 and 7). In this illustration, a first section 48 extends generally perpendicular to the axis 65 of the head, and a second section 49 extends within head 20 at an angle to the first section. In the illustrated example, second sections 49 are angled about 45 or 90 degrees relative to the first section. However, the second section could have nearly any angled orientation relative to the first section. Additional angled or curved sections (i.e., more than two) can also be used to further increase the depth of insertion of the cleaning element. As can be appreciated, the depth of insertion is the length as measured along the cleaning element. Accordingly, the insertion depth of cleaning elements in holes 47 (or molded into the head with the same shape) is the sum of lengths of sections 48, 49. The use of such non-linear sections permits the holes to have different depths of insertion without extending farther into the head. Moreover, even if the holes do extend different distances from mounting surface 24, the thickness of the head can be reduced with the non-linear embedded sections.

Cleaning elements 50 inserted into a common hole 40 are considered to be fastened at a common point below their bases 56 and to be part of the same tuft 30. Similarly, a single tuft of cleaning elements (e.g., bristles) is considered to have the same height from the head even if there are small differences in their extensions. The cleaning elements 50 can be secured in the tuft holes by any known technique including, for example, stapling, pinning or gluing. The cleaning elements may also be anchored into the head by other means not including the pre-forming of a hole, such as molding the cleaning elements into the head (e.g., in mold tufting or anchor free tufting). Irrespective of the manner of fixing the cleaning elements in the head, they can be secured into the head at varying lengths or depths of insertion, and with or without embedded sections that are bent.

Figure 8:
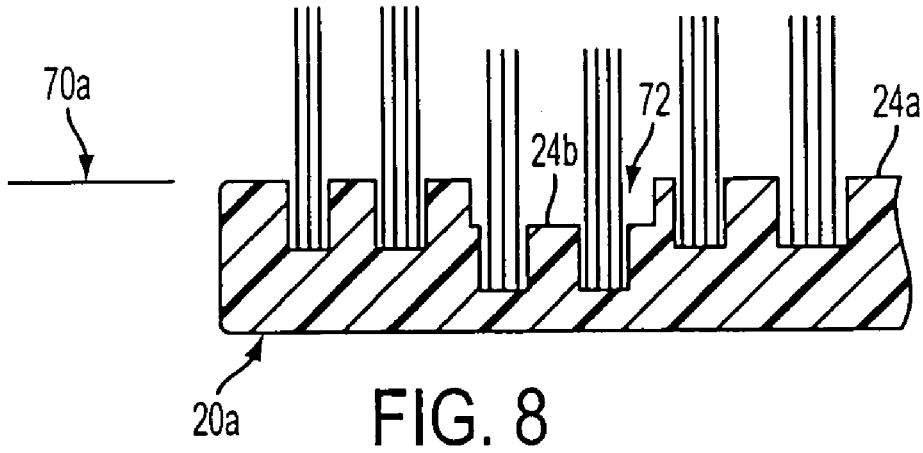
FIG. 8 is a partial longitudinal cross-sectional view of the head of an alternative embodiment.

Other alternatives of the invention include the use of heads with non-planar mounting surfaces 24. For example, head 20*a* may include a recess 72 forming an upper mounting surface 24*a* and a lower mounting surface 24*b* (FIG. 8). In this example, bristles extend into the head beyond their respective mounting surfaces 24*a*, 24*b* an equal distance-irrespective of whether they are mounted in pre-formed holes, molded into the head, attached in another way. In such an embodiment, the bristles are fixed in the head at different depths of insertion relative to the reference plane 70*a*. In this case the reference plane is coextensive with the upper mounting surface 24*a*.

Figure 9:
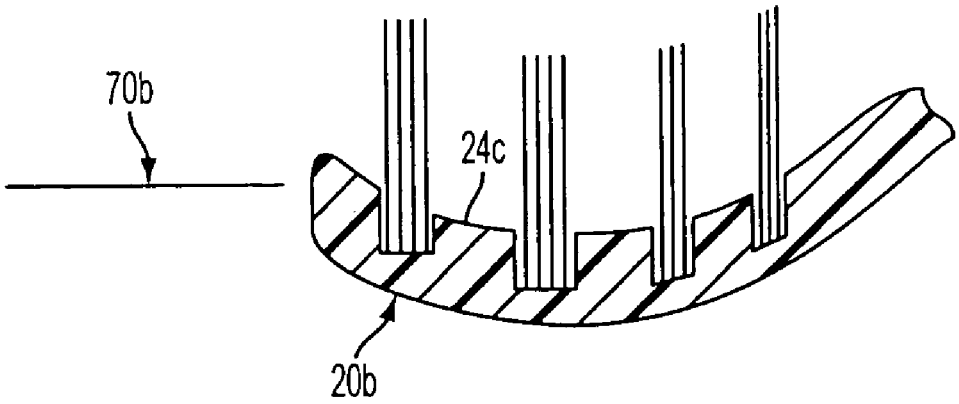
FIG. 9 is a partial longitudinal cross-sectional view of the head of an alternative embodiment.

Another alternative head 20*b* includes a curved mounting surface 24*c* (FIG. 9). Although the bristles or other cleaning elements may extend into the head a uniform distance from mounting surface 24, they each have a different depth of insertion relative to the reference plane 70*b*. This reference plane is generally parallel with a plane of engagement with the user's teeth during use and extending from the outer-most portion of the mounting surface. Of course, non-linear embedded sections can also be used in any of the heads with non-planar mounting surfaces.

A common feature of each of these embodiments is that the depth of insertion is varied relative to a reference plane that extends generally parallel to the plane of engagement formed by the teeth during use, and which extends from an outer-most portion of the mounting surface (i.e., outer in the sense of the projecting direction of the cleaning elements from the head). The depth of insertion is determined by the length the cleaning element extends from the reference plane. The linear length of the cleaning element from the plane is the linear distance along the axis of the cleaning element (whether the element having linear or bent embedded sections) rather than an actual distance from the reference plane to the remotest portion of the cleaning element. In common toothbrushes with a planar mounting surface, the reference plane is coextensive with the mounting surface. However, with non-planar mounting surfaces, the reference plane will be considered to extend from the outer-most portion of the mounting surface.

Figure 5B:
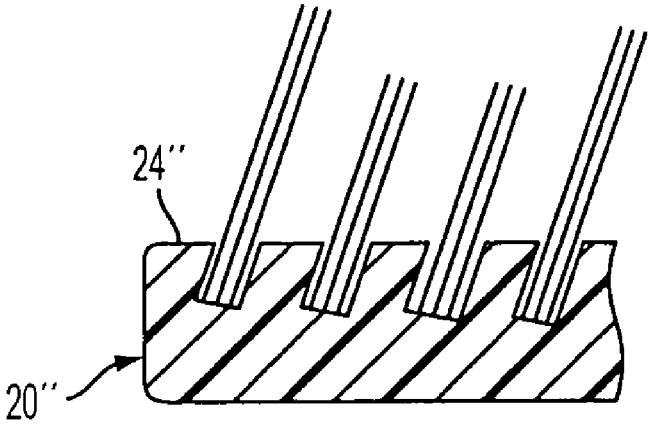
FIG. 5B is a partial longitudinal cross-sectional view of the head of an alternative embodiment.

In any of the above-discussed embodiments, the cleaning elements 50 can extend outwardly from head 20 in a direction generally perpendicular to mounting surface 24 (see, e.g., FIG. 5) or disposed at various angles relative to mounting surface 24" of head 20"(see, e.g., FIG. 5B). Thus, it is possible to select the combination of cleaning element configurations, materials and orientations that deliver the intended oral health benefits, such as enhanced cleaning, tooth polishing, tooth whitening, massaging of the gums and/or comfort.

By attaching the cleaning elements into the head at different insertion depths, a contoured cleaning profile can be achieved without a need for further shaping (e.g., trimming and endrounding) of the cleaning elements after being fixed in the head. Accordingly, an entire process step(s) can be eliminated in the manufacturing process. Further, this process enables the beneficial use of tapered bristles in a contoured cleaning profile. Finally, this process can be used in a wide range of manufacturing processes including, for example, the fixing of bristles into pre-formed holes or the in situ molding of the bristles into the head.

While only a few toothbrush variations are disclosed herein, the invention could be used in toothbrushes having many variations in, for example, the head, handle, and materials used. Alternatively, the toothbrush could be a powered toothbrush. The head 20 can also be removably secured to the handle 12 whether it is powered or manual. Further, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A toothbrush comprising:

a head including a substantially planar mounting surface having a pair of tuft holes extending a first depth into the head from the mounting surface, a pair of tuft holes extending a second depth into the head from the mounting surface and at least one tuft hole extending a third depth into the head from the mounting surface;

a tuft of bristles having tapered terminal ends disposed in each of:

the tuft holes extending the first depth into the head, tuft holes extending the second depth into the head, and the tuft hole extending the third depth into the head;

wherein the pair of tuft holes extending the second depth is located between the pair of tuft holes extending the first depth, and the tuft hole extending the third depth is located between the pair of tuft holes extending the second depth;

wherein the tufts of bristles are substantially the same length and extend from the mounting surface, and wherein the third depth is greater than the second depth and the second depth is greater than the first depth, the tapered terminal ends of the tufts of bristles forming a contoured cleaning profile relative to a reference plane.

2. A toothbrush in accordance with claim 1 wherein the tufts of bristles extend into the head at an orientation generally perpendicular to the reference plane.

3. A toothbrush in accordance with claim 1 wherein the tufts of bristles extend into the head at an inclination less than 90° relative to the mounting surface.

4. A toothbrush in accordance with claim 1 wherein the tufts of bristles include an anchoring portion secured in the head and a pair of strands extending out of the head.

5. A toothbrush in accordance with claim 4 wherein at least one of the strands of the pair have a tapered terminal end.

6. A toothbrush in accordance with claim 4 wherein both strands of the pair have tapered terminal ends.

7. A toothbrush comprising:

a head including a substantially planar mounting surface;

a plurality of first tufts of bristles having tapered terminal ends, the plurality of first tufts of bristles being embedded a first distance into the head from said mounting surface;

a plurality of second tufts of bristles having tapered terminal ends, the plurality of second tufts of bristles being embedded a second distance into the head from said mounting surface; and a third tuft of bristles having tapered terminal ends, the third tuft of bristles being embedded a third distance into the head from said mounting surface;

wherein the third distance is greater than the second distance and the second distance is greater than the first distance;

wherein the first, second and third tufts of bristles are substantially the same length; and wherein the plurality of first tufts of bristles, the plurality of second tufts of bristles and the third tuft of bristles extend from the mounting surface so that the tapered terminal ends of the plurality of first tufts of bristles, the plurality of second tufts of bristles and the third tuft of bristles form a singularly contoured cleaning profile relative to a reference plane that is substantially coextensive with the mounting surface, and wherein the contoured cleaning profile comprises a first apex formed by a first one of the plurality of first tufts of bristles and a second apex formed by a second one of the plurality of first tufts of bristles, the first and second apexes located on opposite ends of the singularly contoured cleaning profile, the plurality of second tufts and the third tuft located between the first and second apexes.

8. A toothbrush in accordance with claim 7 wherein the head includes pre-formed holes into which the plurality of first tufts of bristles, the plurality of second tufts of bristles and the third tuft of bristles are embedded.

9. A toothbrush in accordance with claim 7 wherein the pair of first tufts of tapered bristles, the pair of second tufts of tapered bristles and the third tuft of bristles are molded into the head.

10. A toothbrush in accordance with claim 7 wherein the pair of first tufts of tapered bristles, the pair of second tufts of tapered bristles and the third tuft of bristles include a portion within the head that includes two sections that are bent relative to each other.

11. A method of making a toothbrush comprising:

forming a head having a substantially planar mounting surface;

securing a pair of first tufts of tapered bristles in the head at a first depth of insertion into the planar mounting surface of the head;

securing a pair of second tufts of tapered bristles in the head between the pair of first tufts of tapered bristles, the pair of second tufts of tapered bristles secured in the head at a second depth of insertion into the planar mounting surface of the head; and securing a third tuft of tapered bristles in the head between the pair of second tufts of bristles, the third tuft of tapered bristles secured in the head at a third depth of insertion into the planar mounting surface of the head;

wherein the third depth of insertion is greater than the second depth of insertion and the second depth of insertion is greater than the first depth of insertion, and terminal ends of the pair of first tufts of tapered bristles, the pair of second tufts of tapered bristles and the third tuft of tapered bristles forming a contoured cleaning profile; and wherein the pair of first tufts of tapered bristles, the pair of second tufts of tapered bristles and the third tuft of tapered bristles have substantially the same length.

12. A method in accordance with claim 11 wherein the step of forming the head includes forming a plurality of holes in the planar mounting surface, and wherein the step of securing the pair of first tufts of tapered bristles, the pair of second tufts of tapered bristles and the third tuft of tapered bristles in the head includes anchoring the pair of first tufts of tapered bristles, the pair of second tufts of tapered bristles and the third tuft of tapered bristles in the holes.

13. A method in accordance with claim 12 wherein the terminal ends of the pair of first tufts of tapered bristles, the pair of second tufts of tapered bristles and the third tuft of tapered bristles form the contoured profile without being further shaped after being secured in the head.

14. A method in accordance with claim 11 wherein the step of securing the pair of first tufts of tapered bristles, the pair of second tufts of tapered bristles and the third tuft of tapered bristles in the head includes molding a base portion of each of the pair of first tufts of tapered bristles, the pair of second tufts of tapered bristles and the third tuft of tapered bristles in the head.

15. A method in accordance with claim 11 wherein the step of securing the pair of first tufts of tapered bristles, the pair of second tufts of tapered bristles and the third tuft of tapered bristles in the head includes fixing a portion of said pair of first tufts of tapered bristles, the pair of second tufts of tapered bristles and the third tuft of tapered bristles into the head such that the portion includes two sections that are bent relative to each other.

* * * * *